US005660117A

United States Patent [19]

Noble

[11] Patent Number: 5,660,117

[45] Date of Patent: Aug. 26, 1997

[54] FOLDABLE READING TRAY

[76] Inventor: Helen M. Noble, 1057 Tall Trees Dr., Upper St. Clair, Pa. 15241

[21] Appl. No.: 590,596

[22] Filed: Jan. 24, 1996

[51] Int. Cl.[6] ..... A47B 3/00

[52] U.S. Cl. ..... 108/35; 312/233; 248/460

[58] Field of Search ..... 312/244, 233, 312/231, 258; 108/34, 35; 298/454, 460, 461

[56] References Cited

U.S. PATENT DOCUMENTS

| | | | |
|---|---|---|---|
| 1,198,180 | 9/1916 | Berg . | |
| 2,054,098 | 9/1936 | Rich | 311/25 |
| 2,708,808 | 5/1955 | Simpson | 312/233 |
| 3,123,935 | 3/1964 | Williams | 45/85 |
| 3,652,051 | 3/1972 | McFarlene | 248/444 |
| 3,768,768 | 10/1973 | Benlian | 248/456 |
| 3,936,109 | 2/1976 | Richardson | 312/231 |
| 4,034,518 | 7/1977 | Trecker | 312/244 |
| 4,050,658 | 9/1977 | Forman et al. | 248/13 |
| 4,119,289 | 10/1978 | Kanocz | 248/454 |
| 4,610,417 | 9/1986 | Kuss | 248/460 |
| 5,129,616 | 7/1992 | Carson | 248/457 |
| 5,129,715 | 7/1992 | Maynard, Jr. | 312/351.9 |
| 5,281,019 | 1/1994 | Rodeck | 312/244 |
| 5,315,935 | 5/1994 | Weisenfels | 108/193 |
| 5,348,263 | 9/1994 | Hubbard | 248/444 |

*Primary Examiner*—Peter M. Cuomo
*Assistant Examiner*—Gerald A. Anderson
*Attorney, Agent, or Firm*—Webb Ziesenheim Bruening Logsdon Orkin & Hanson, P.C.

[57] ABSTRACT

The present invention discloses a portable, foldable reading tray. The reading tray includes a pair of tray members which is hinged to each other and pivotable between an operative position defining a desktop surface adapted to be inclined relative to the horizontal, and a stored position defining a hollow interior within said pair of tray members. At least one leg is coupled to each tray member and movable between an operative position supporting the desktop surface and a stored position within the hollow interior. A bolster is coupled to and extends across the desktop surface when in the operative position. A light may be coupled to one tray member and movable to a stored position wherein the light is protected by the bolster.

18 Claims, 5 Drawing Sheets

FOLDABLE READING TRAY

BACKGROUND OF THE INVENTION

1. Field of the Invention

The present invention relates to reading trays and, more specifically, the present invention relates to portable, foldable reading trays.

2. Prior Art

A wide variety of portable, collapsible reading trays are known in the prior art. Examples of such reading trays can be found in U.S. Pat. Nos. 5,348,263; 5,129,616; 4,119,289; 4,050,658; 3,768,768; 3,652,051; 2,054,098; and 1,198,180. Additionally, a variety of portable desks, drafting tables and folding music holders have been developed. Representative examples of these include U.S. Pat. Nos. 5,315,935; 5,281,019; 5,129,715; 4,610,417; and 3,123,935. Although the prior art discloses a wide variety of collapsible tray, desk and stand arrangements, these arrangements do not provide a simple, foldable reading tray collapsible into an attractive, compact and protective unit.

The object of the present invention is to overcome the aforementioned difficulties of the prior art to provide a foldable reading tray which easily folds into an attractive, compact arrangement protecting the various components of the reading tray in the stored position. A further object of the present invention is to provide a foldable reading tray which is easily and economically manufactured.

SUMMARY OF THE INVENTION

These and other objects of the present invention are satisfied by providing a portable reading tray which includes a pair of tray members hinged to each other which are pivotable between an operative position and a stored position. Each of the tray members includes a substantially planar top panel. The top panels are alignable with each other to form a desktop surface when the tray members are in the operative position. A peripheral lip extends from an underside of each top panel. The peripheral lips and top panels of the pair of tray members cooperate to define a hollow interior when in the stored position. At least one leg is coupled to each tray member and movable between an operative position supporting the desktop surface and a stored position within the hollow interior which is formed by the tray members in the stored position.

One embodiment of the present invention includes a bolster member coupled to each top panel with the bolster members aligned in the operative position to form a bolster extending across the desktop surface. The desktop surface may be inclined relative to the horizontal with the tray members in the operative position. The leg members may be adjustable in height to adjust the incline of the desktop surface.

The present invention may additionally include a light coupled to one of the tray members with the light movable between an operative position and a stored position. The light may include a stem and lamp member with the lamp member positioned adjacent the bolster member when the light is in the stored position. The lamp member preferably has a thickness less than the height of the bolster such that the bolster can protect the lamp when in the stored position.

These and other advantages of the present invention will be clarified in the description of the preferred embodiment taken in connection with the attached figures wherein like reference numerals represent like elements throughout.

BRIEF DESCRIPTION OF THE PREFERRED EMBODIMENT

Figure 1:
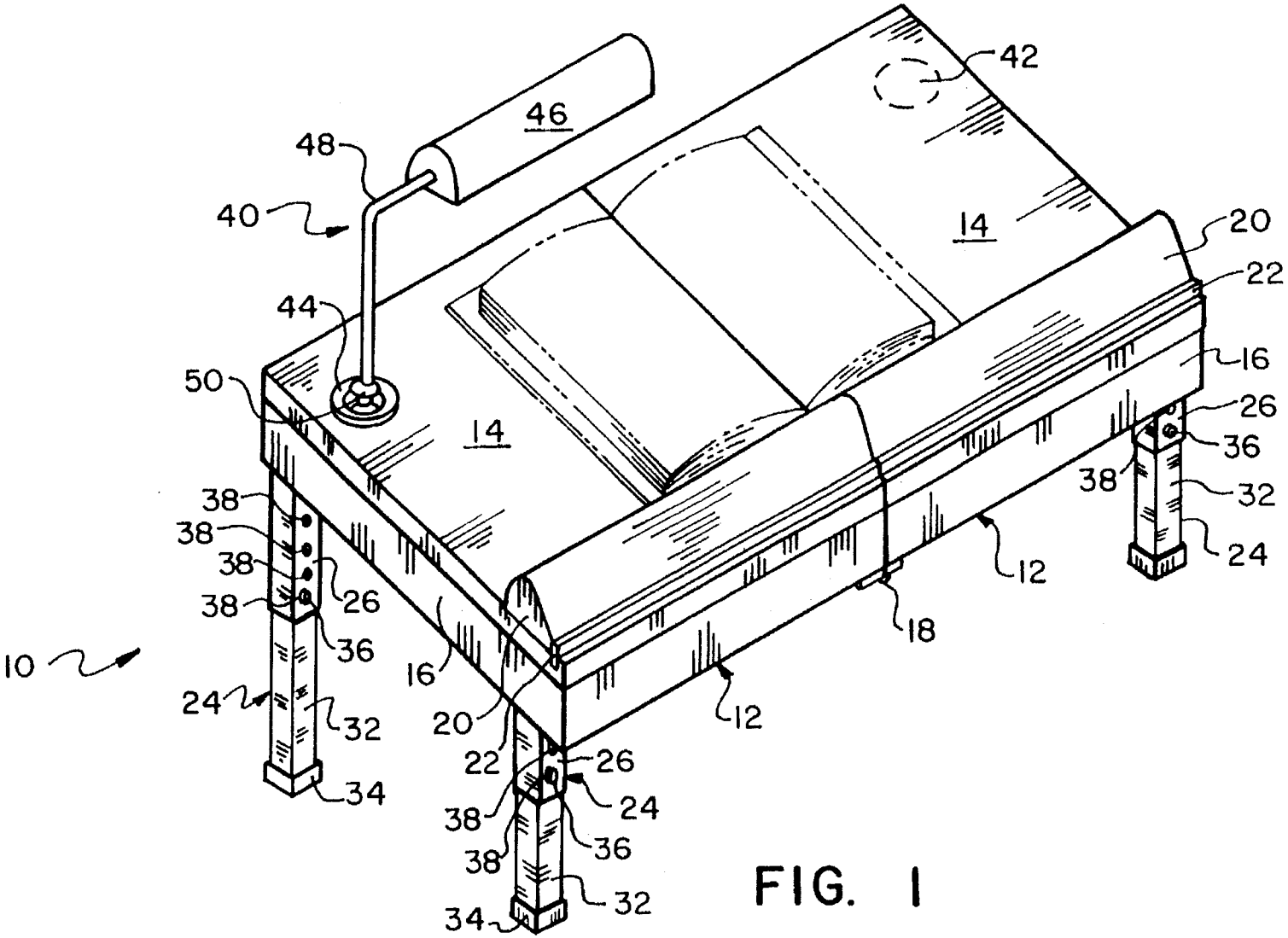
FIG. 1 is a perspective view of a foldable reading tray according to the present invention.

FIG. 1 illustrates a perspective view of a foldable reading tray 10 according to the present invention. The foldable reading tray 10 includes a pair of tray members 12 hinged to each other and pivotable between an operative position illustrated in FIG. 1 and a stored position illustrated in FIG. 5 as will be discussed hereinafter. Each tray member 12 includes substantially planar top panel 14 preferably of a rectangular configuration. The top panels 14 of the pair of tray members 12 are alignable with each other in the operative position, as illustrated in FIG. 1, to form a desktop surface.

Figure 2:
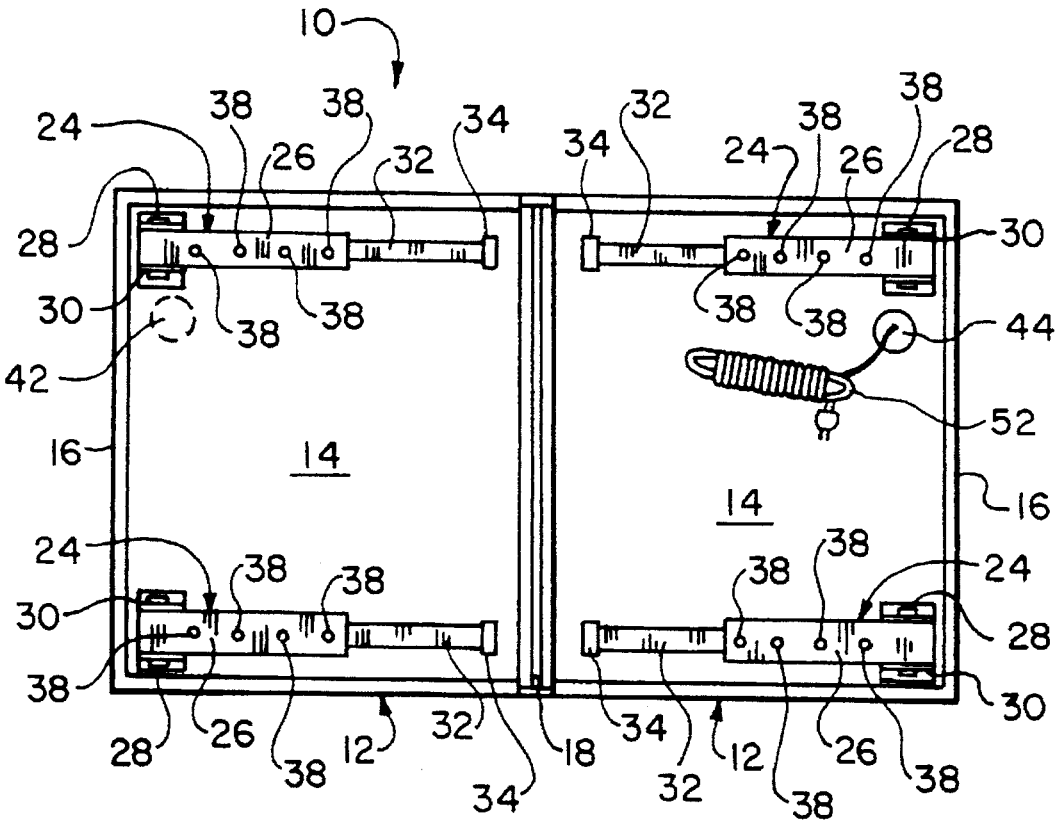
FIG. 2 is a bottom plan view of the foldable reading tray illustrated in FIG. 1 with the legs thereof pivoted to a retracted position.

A peripheral lip 16 extends from an underside of the top panel 14 of each tray member 12 and extends substantially around the periphery of the rectangular top panel 14 as illustrated in FIG. 2. A piano hinge 18 is attached to the adjacent portions of the peripheral lips 16 of the tray member 12 to hinge the tray members 12 together.

Figure 5:
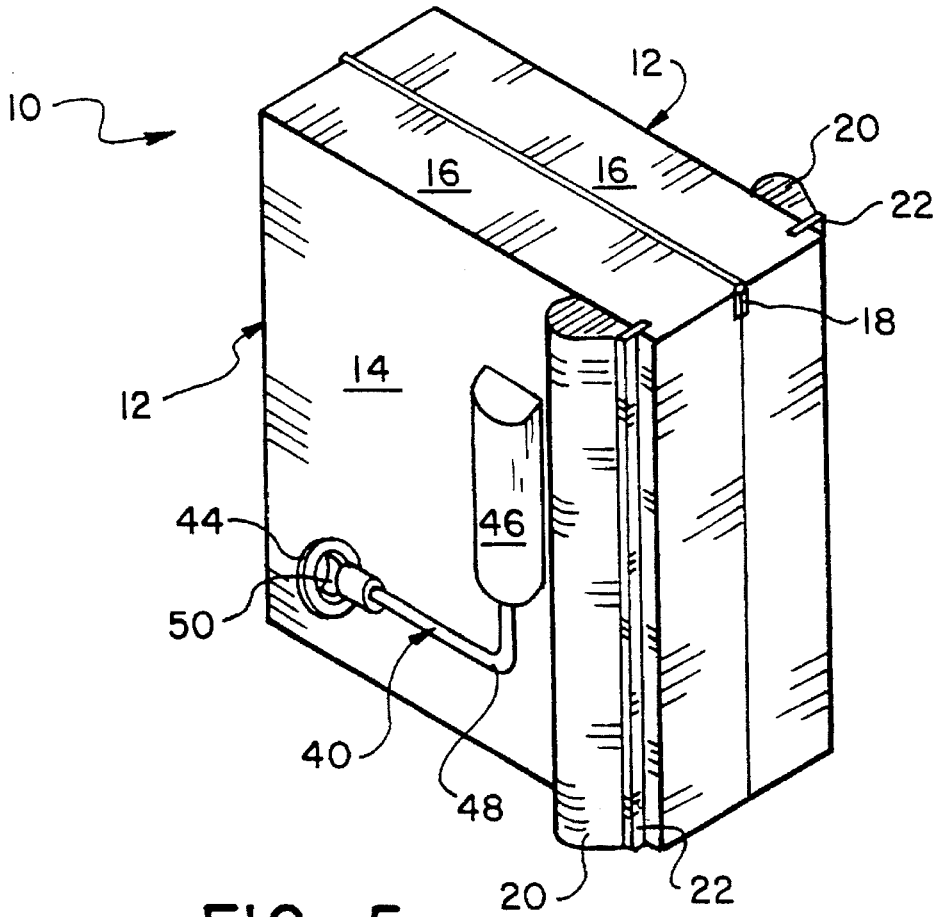
FIG. 5 is a perspective view of the foldable reading tray illustrated in FIGS. 1–4 with the reading tray in the stored position.

A padded fabric bolster member 20 is releasably attached to each tray member 12 along a lowermost edge of each top panel 14. A bolster stop 22 is received in a groove in the top panel 14 to help locate and secure each bolster member 20 into position. In the operative position, the bolster members 20 are alignable to form a bolster extending across the desktop surface as illustrated in FIG. 1. As shown in FIGS. 1 and 5, the padded fabric bolster member 20 preferably has a cross section which narrows toward a rearward end thereof. Each bolster member 20 is preferably removable to allow for easy cleaning of the fabric bolster member 20. The specific shape of the bolster member 20 provides a convenient stop for a book (illustrated in phantom in FIG. 1) as well as an ergonomic arm rest for the user. Alternatively, the bolster members 20 may be formed of rubber for ease of cleaning. A rubber bolster member would preferably have the same ergonomic shape as shown in the figures.

Figure 3:
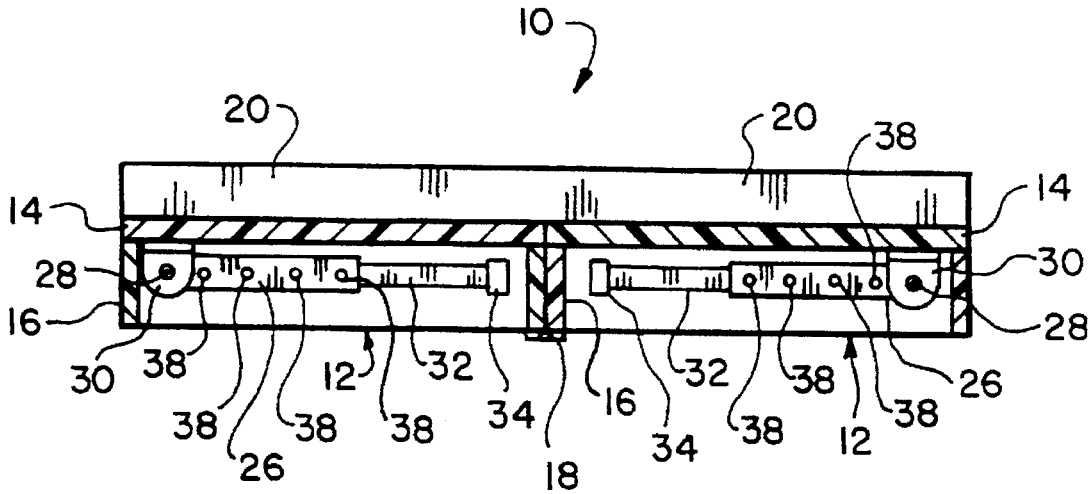
FIG. 3 is a sectional view of the foldable reading tray illustrated in FIG. 2.

A pair of height-adjustable legs 24 is pivotally attached to each tray member 12 at an underside of the top panel 14 within the area bounded by the peripheral lip 16 as shown in FIGS. 2 and 3. Each leg 24 is pivoted between an operative position illustrated in FIG. 1 to support the desktop surface and a stored position illustrated in FIGS. 2–4 with the leg 24 positioned within the hollow interior defined by the peripheral lips 16 and top panels 14 of the tray members 12.

Figure 6:
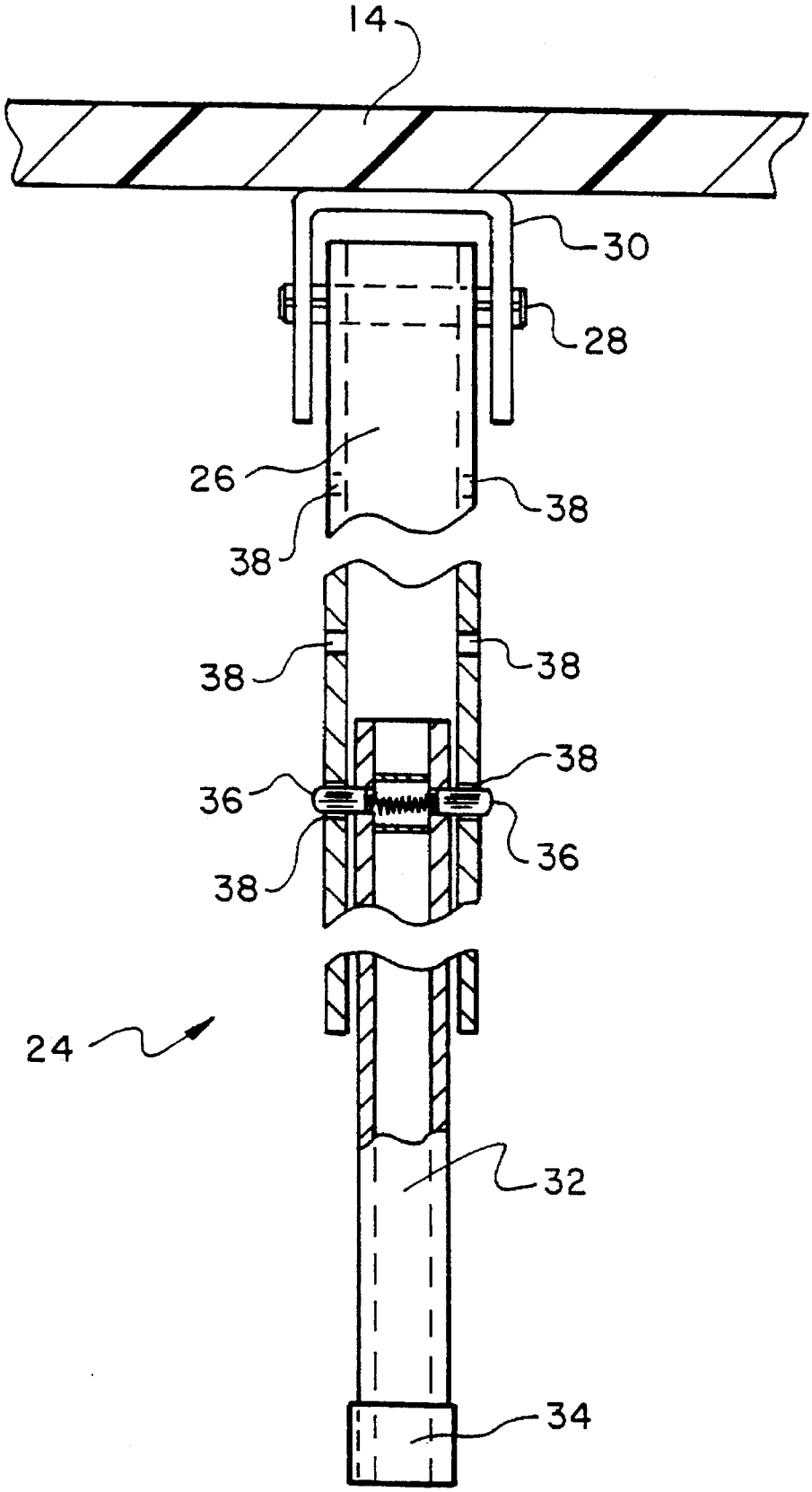
FIG. 6 is an enlarged view of a leg of the foldable reading tray illustrated in FIGS. 1–5.
Figure 7:
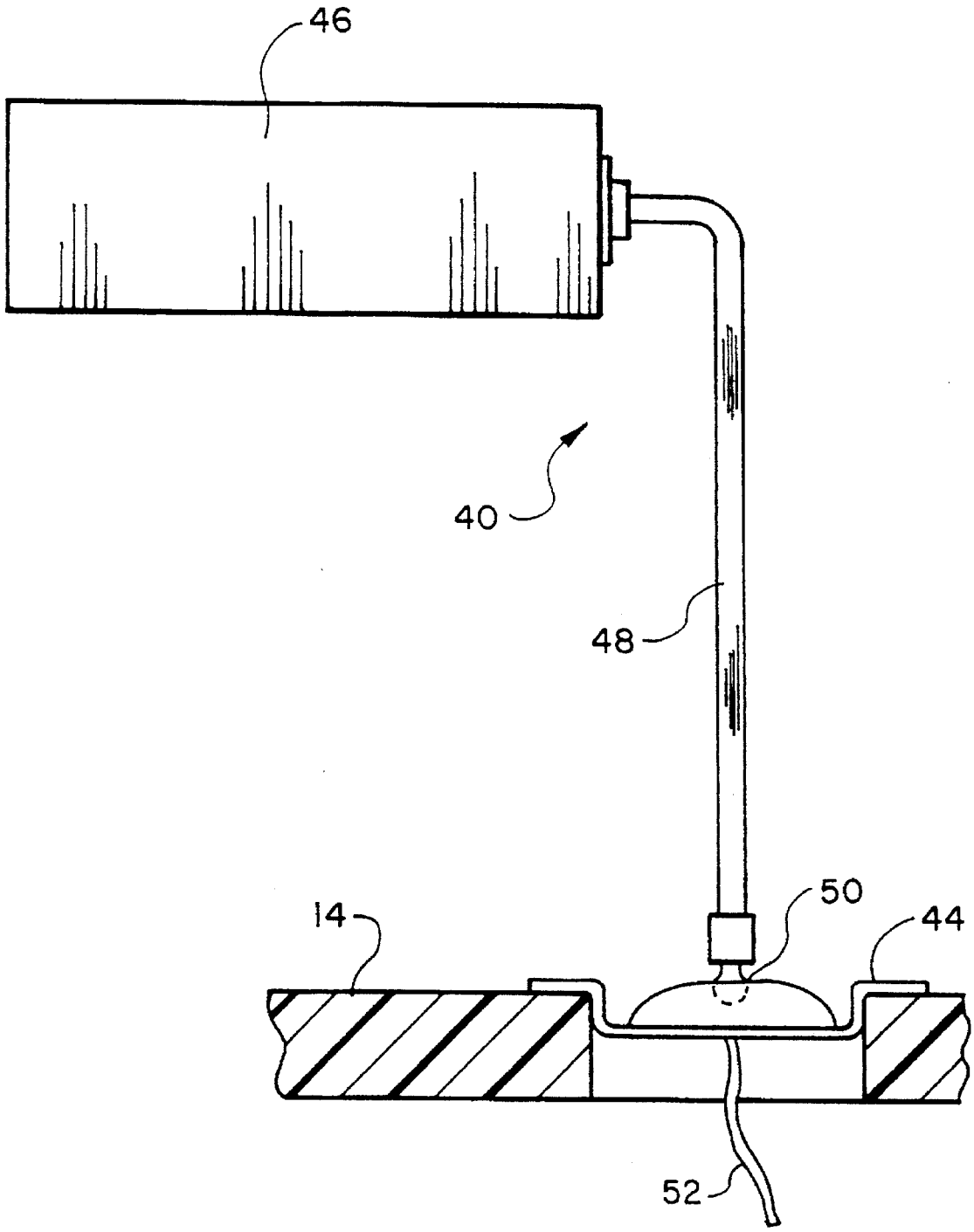
FIG. 7 is an enlarged side view, partially in section, of a light of the foldable reading tray illustrated in FIGS. 1–5.

The structure of each leg 24 is illustrated in better detail in FIG. 6. Each leg 24 includes a hollow upper leg member 26 pivotally attached by pin 28 to bracket 30 secured to the underside of the top panel 14. A lower leg member 32 is slidably received within the hollow interior of the upper leg member 26 in a telescoping manner. The lower leg member 32 includes a foot 34 on a lower end thereof and a pair of spring-biased connecting pins 36 at an upper end thereof. The spring-biased connecting pins 36 are adapted to be received within one set of positioning holes 38 formed along the upper leg member 26. The positioning holes 38 are positioned at spaced locations along the upper leg member 26 and allow for the height adjustment of the leg 24 to a plurality of discrete locations. As shown in FIG. 1, the leg 24 at the forwardmost portion of the reading tray 10 has a greater number of discrete positions defined by a greater number of positioning holes 38 than the leg 24 in the rear of the reading tray 10.

The adjustable legs 24 are utilized to vary the height and inclination of the desktop surface formed by top panels 14. The adjustable legs 24 are preferably positioned such that the top panels 14 are inclined relative to the horizontal in the operative position as shown in FIG. 1. One may also utilize the reading tray 10 by leaving the rear legs 24 folded and supporting the rear portion of the reading tray 10 on the user's bent legs. The forward portion of the reading tray 10 would be supported by front legs 24 in the open position. The reverse is also possible (i.e., the front legs 24 folded, the rear legs 24 open and the front of the reading tray 10 supported on the user's legs). These examples show the versatility of independent foldable legs 24.

A light 40 may be attached to one tray member 12 on the top panel 14. The light 40 is adapted to be attached to either of the tray members 12. Prior to receiving light 40, each top panel 14 includes a scored punch-out section 42. The punch-out section 42 is removed to receive a corresponding light retainer 44 to install the light 40. The light 40 includes a lamp member 46 and a stem 48 attached by a universal-type joint 50 to light retainer 44. A conventional cord and plug 52 may extend from joint 50 and is adapted to be connectable with a conventional source of electrical power. Alternatively, a battery source may be used to power light 40 with an appropriate battery holder attached to the light retainer 44.

The light 40 is movable between an operative position illustrated in FIG. 1 and a retracted or stored position illustrated in FIG. 5 with the lamp member 46 being positioned substantially adjacent and parallel to the bolster member 20. In the present invention, it is intended that the lamp member 46 and stem 48 have a width less than the height of the bolster member 20. With this configuration, the bolster member 20 will serve to protect the lamp member 46 when in the stored position.

The foldable reading tray 10 of the present invention may be formed out of any conventional materials including, but not limited to, plastic, metal, wood or the like and combinations thereof. If plastic is utilized to form many of the components of the foldable reading tray 10 of the present invention, the present design allows for many of the components to be integrally formed, thereby saving manufacturing costs.

Figure 4:
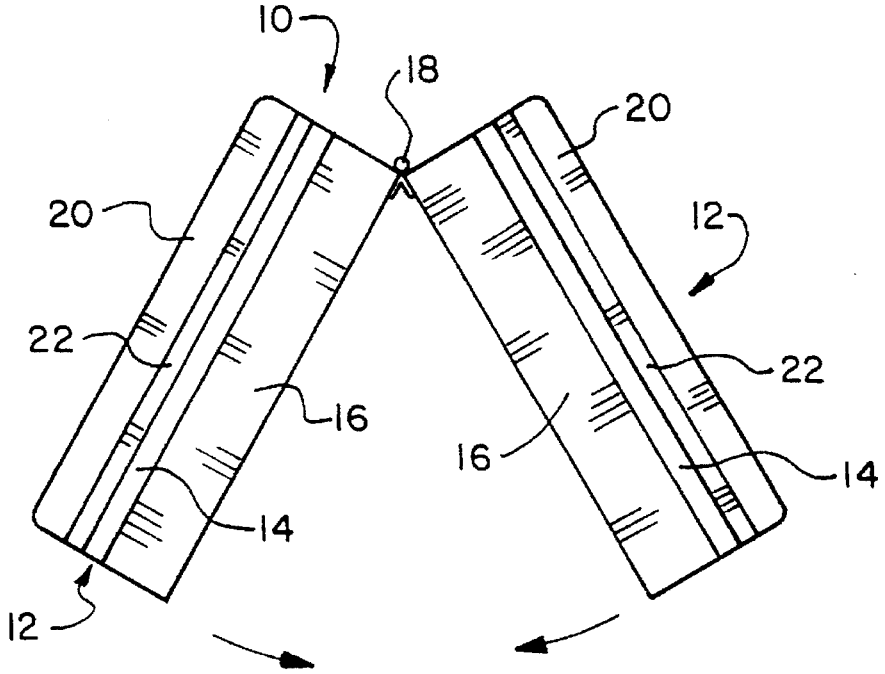
FIG. 4 is a side view of the foldable reading tray illustrated in FIG. 3 with the reading tray being moved to the stored position.

In the operative position, the tray members 12 are extended to align the top panels 14 and bolster members 20 as shown in FIG. 1. Additionally, the legs 24 are extended to an operative position extending away from the top panels 14 with the connecting pins 36 adjusting the height of the legs 24 to achieve the desired tilt of the desktop surface such as illustrated in FIG. 1. To move the reading tray 10 to the stored position, the lamp member 46 and stem 48 are pivoted to a position adjacent the top panel 14 with the lamp member 46 extending substantially parallel and adjacent to the bolster member 20 as illustrated in FIG. 5. The adjustable legs 24 are pivoted to a position adjacent the underside of the top panel 14 within the area defined by the peripheral lip 16 as illustrated in FIGS. 2 and 3. The cord and plug 52 can be wound and stored within the area defined by the peripheral lip 16. Additionally, a book or the like may be stored within the area defined by the peripheral lip 16. The tray members 12 are then pivoted together, as illustrated in FIG. 4, to the stored position illustrated in FIG. 5. In the stored position, the legs 24 and cord and plug member 52 and any other stored element, such as a book, are protected within the interior defined by the closed tray members 12. Additionally, in the stored position, the light 40 is protected by the bolster member 20. The compact arrangement in FIG. 5 allows for easy storage of the foldable reading tray 10 in a manner protecting the components of the reading tray 10. Additionally, all of the elements of the reading tray 10 are coupled together in both the operative and stored positions which minimizes the likelihood of loss of the individual components of the reading tray 10.

The present design of the reading tray 10 allows for easy customization of individual reading tray 10. Specifically, the bolster member 20 can be easily replaced with a fabric bolster member 20 having the design considered appropriate by the individual user. Additionally, the light 40 can be positioned on either tray member 12 by knocking out the appropriate punch-out section 42 in the appropriate top panel 14. Additionally, legs 24 are adjustable and can be easily replaced by removal of pin 28 and attachment of the new leg.

It will be apparent to those of ordinary skill in the art that various modifications may be made to the present invention without departing from the spirit and scope thereof. Consequently, the scope of the present invention is intended to be defined by the attached claims.

What is claimed is:

1. A portable reading tray comprising:

a) a pair of tray members hinged to each other and pivotable between an operative position and a stored position, each said tray member including i) a top panel which when said tray member is in said operative position said top panel is alignable with said top panel of the other of said pair of tray members to form a desktop surface, ii) a peripheral lip extending from an underside of said top panel wherein said peripheral lips of said pair of tray members and said top panels of said pair of tray members cooperate to define a hollow interior when in said stored position;

b) at least one leg coupled to each said tray member movable between an operative position and a stored position within said hollow interior; and c) a bolster member coupled to each said top panel, wherein said bolster members are alignable in said operative position forming a bolster extending across said desktop surface.

2. A portable reading tray as claimed in claim 1 wherein said desktop surface is adapted to be inclined relative to the horizontal in said operative position.

3. A portable reading tray as claimed in claim 2 wherein each said leg is adjustable in height to adjust said incline of said desktop surface in said operative position.

4. A portable reading tray as claimed in claim 1 wherein each said bolster member is a padded fabric bolster releasably attached to said top panel.

5. A portable reading tray as claimed in claim 1 further including a light coupled to one said top panel of one said tray member.

6. A portable reading tray as claimed in claim 5 wherein said light is movable between an operative position and a stored position.

7. A portable reading tray as claimed in claim 6 wherein said light is pivotally attached to said top panel, said light pivotable between said operative position and said stored position.

8. A portable reading tray as claimed in claim 7 wherein said light includes a stem and a lamp member wherein said lamp member is positioned adjacent said bolster member.

9. A portable reading tray as claimed in claim 8 wherein said lamp member has a thickness less than a height of said bolster.

10. A portable reading tray as claimed in claim 1 further including at least one hinge member attached to said peripheral lips of said pair of tray members, said at least one hinge member providing said pivotable connection of said tray members.

11. A portable reading tray as claimed in claim 1 wherein a pair of said legs is coupled to each said tray member.

12. A portable reading tray as claimed in claim 11 wherein each said leg is pivotally attached to each said tray member.

13. A portable reading tray as claimed in claim 12 wherein each said leg is adjustable in height.

14. A portable reading tray as claimed in claim 13 wherein each said leg includes a plurality of discrete height positions providing for said adjustability in height of said leg.

15. A portable reading tray as claimed in claim 14 wherein one of said pair of legs on each said tray member has a greater number of discrete height positions than the other of said pair of legs on each said tray member.

16. A portable reading tray as claimed in claim 1 wherein each said bolster member is a padded fabric bolster having a cross section which narrows toward a rearward portion thereof.

17. A portable reading tray as claimed in claim 1 wherein each said top panel includes a punch-out section adaptable to receive a light therein.

18. A portable, foldable reading tray movable between an operative position and a stored position, said reading tray comprising:

a) a pair of tray members hinged to each other and pivotable between said operative position and said stored position, each said tray member including i) a substantially planar top panel which when in said operative position said top panel is alignable with said top panel of the other of said pair of tray members to form a desktop surface, said desktop surface adapted to be inclined relative to the horizontal in said operative position, ii) a peripheral lip extending from an underside of said top panel wherein said peripheral lips and said top panels of said pair of tray members cooperate to define a hollow interior in said stored position, iii) at least one hinge member connecting said peripheral lips of said pair of tray members forming said pivotable connection between said pair of tray members;

b) a pair of height-adjustable legs pivotally attached to each said tray member, each said leg pivotable between an operative position supporting said desktop surface in said inclined position, and a stored position with said leg positioned within said hollow interior formed by said pair of tray members;

c) a bolster member coupled to each said top panel, wherein said bolster members of said pair of tray members are alignable in said operative position forming a bolster extending across a lowermost portion of said desktop surface; and d) a light pivotally attached to one said top panel of one said tray member, said light pivotable between said operative position and said stored position, said light including a stem and a lamp member wherein said lamp member is positioned adjacent said top panel and said bolster member when in said stored position wherein said lamp member has a thickness less than a height of said bolster.

* * * * *